United States Patent [19]

Blee

[11] Patent Number: 4,708,085

[45] Date of Patent: Nov. 24, 1987

[54] MARINE HULL

[76] Inventor: Leonard J. Blee, 66 Leslie Avenue, Blair Athol, Australia, 5084

[21] Appl. No.: 864,822

[22] Filed: May 19, 1986

[51] Int. Cl.[4] ..... B63B 1/32

[52] U.S. Cl. ..... 114/290; 114/288; 114/291

[58] Field of Search ..... 114/56, 61, 288, 289, 114/290, 291

[56] References Cited

U.S. PATENT DOCUMENTS

| | | | |
|---|---|---|---|
| 1,050,517 | 1/1913 | Chase | 114/290 |
| 1,074,951 | 10/1913 | Hunt | 114/289 |
| 3,216,389 | 11/1965 | Thorsen | 114/56 |
| 4,159,691 | 7/1979 | Paxton | 114/290 |
| 4,224,889 | 9/1980 | Spiegel | 114/61 |

*Primary Examiner*—Joseph F. Peters, Jr.
*Assistant Examiner*—Thomas J. Brahan
*Attorney, Agent, or Firm*—Rodman & Rodman

[57] ABSTRACT

A marine hull including a plurality of channels extending rearwardly and inclined, in plan, with respect to the central longitudinal vertical plane of the hull, the cross-sectional shape of each channel being curved so that its surface intercepts water when the hull is mobile and that water is caused to leave each channel in a downward direction thereby imparting lift over a major portion of the length of the hull.

12 Claims, 13 Drawing Figures

FIG 1
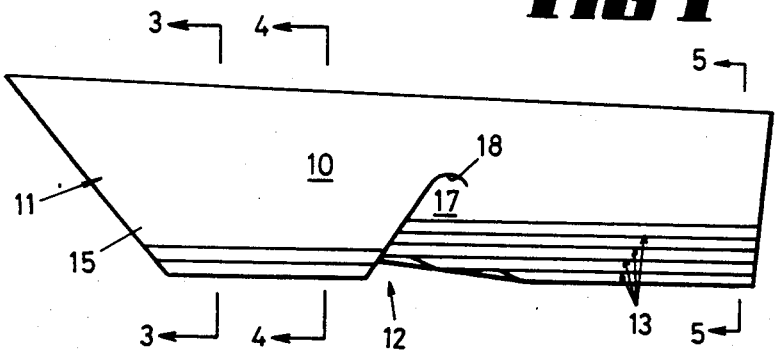
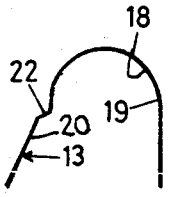
FIG 2A
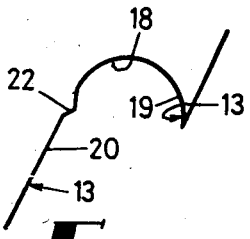
FIG 2B
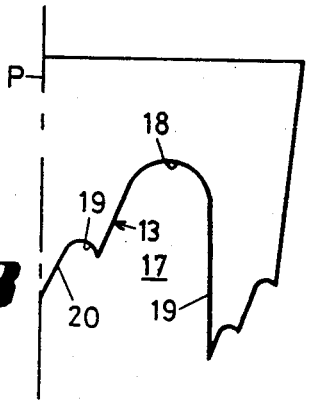
FIG 3
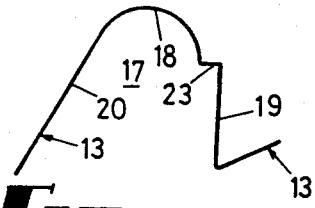
FIG 2C
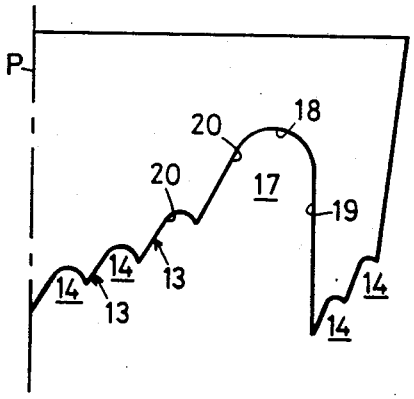
FIG 4
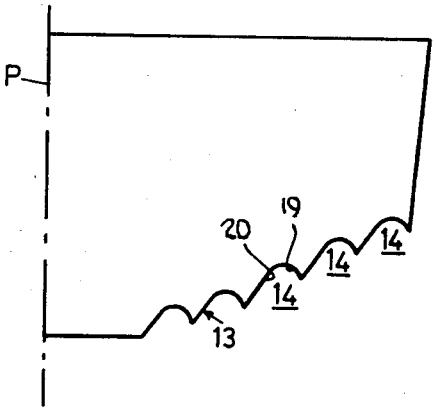
FIG 5

MARINE HULL

This invention relates to a marine planing hull which is suitable for boats operating above displacement speed through the water, and is directed to the achievement of superior qualities with regard to softness of ride through rough water, stability, and general seaworthiness.

BACKGROUND OF THE INVENTION

For many years designers have strived to provide the preceding qualities in their hulls, and the "deep V" hull, the catamaran or tunnel hull and the hydrofield designs have evolved. However, in gaining the ride softness, the designs have always been a trade-off to degrading some other quality. In the case of the "deep V", increased draft and lack of stability at rest, the catamaran has increased cost of manufacture, increased draft and requires twin powerplants if heavy loads are carried, and the hydrofield requires a narrow beam and shows a lack of buoyancy in the bow.

The development of understanding of planing hulls has taken place only in the last 40 years, and the basic authority is a book entitled "Naval Architecture of Planing Hulls" by Dr Lindsay Lord (Cornell Maritime Press, Inc, Cambridge, Md. USA). On page 31 of the Third Edition of said book there is a reference to the lifting forces and the suction forces which exist in a planing hull, and it is stated (apparently correctly) that it is the change of directional momentum of water particles striking the plane that kinetic energy is transferred. In terms of useful work, lift occurs only at those points where kinetic energy is being impressed upon the water. The amount of lift at these points will vary approximately as the cosine of the true planing angle at a given point.

The most commonly used planing hull has a V-shaped bottom with smooth surfaces and the dead rise angle rapidly increases at the forefoot end of the bottom. Accordingly in many instances, under normal usage, water will flow upwardly over the planing surfaces at the forefoot end, and although that flow will cause a considerable degree of lift, it will cause an upwardly directed bow wave which necessarily results in loss of lift and wastes energy. Furthermore the bow wave on each side of the central longitudinal plane of the bottom will cooperate with the bow wave on the other side to define an angle which may be in the vicinity of 90° and is sometimes obtuse so that the lifting pressure rapidly diminishes rearwardly of the forefoot.

Referring further to the Lord textbook, on page 63 of said edition, reference is made to the forebody sections, and the advantages and disadvantages of various shapes are discussed. The effect of dead rise is discussed and further advantages discussed with respect to lateral plane on page 67, where it is pointed out that a hull suited to blue water cruising has a "more generous lateral plane, distributed fore and aft throughout the underbody".

These considerations led Lord to the conclusion that monohedron lines were the most desirable and that running lines shall be "straight and parallel with each other". The development since that time has been based upon the accurate statements of Lord which can be shown to be correct, but there are necessarily compromises which are reached in the design, and any advantages, for example due to the cross-sectional shape of the hull bottom is accompanied by disadvantages. For example, by having the shape of the hull bottom to comprise a pair of downwardly concave planing surfaces, the water displaced by the hull can be redirected downwards by the curvature and thereby increase the available lift, but hulls which are constructed to this shape pound (that is, hydraulically bottom) and produce extremely high shock loading on to the hull structure upon encountering rough water and there is also more tendency for them to broach than with the more conventional convex hull shapes.

By increasing deadrise into a deep "V" shape, the lateral plane is increased quite effectively and the steeply sloping plane surfaces of the bottom upon tilting result in a correcting moment which is much higher than with bottoms of small deadrise (say 10°) but there is an increased draft and also an instability when the boat is at anchor and does not have the benefit of the dynamic righting forces. An object therefore of this invention is to provide a hull shape which will provide required softness of ride without the instability at anchor and without unnecessarily large lateral planes.

The statements contained in the Lord textbook relating to parallel running lines are obviously correct, but in this invention parallelism is either reduced or completely obviated and consequently some of the benefits due thereto are lost, but experience and tank tests have indicated that the compromise is much in favour of this invention, that is, there is much improvement in the softness of ride for a very small cost in the planing efficiency.

BRIEF SUMMARY OF THE INVENTION

In an embodiment of this invention a marine hull includes a plurality of channels extending rearwardly and inclined, in plan, with respect to the central longitudinal vertical plane of the hull, the cross-sectional shape of each channel being curved so that its surface intercepts water when the hull is mobile and that water is caused to leave each channel in a downward direction thereby imparting lift over a major portion of the length of the hull.

More specifically, in this invention, a marine hull has a bottom shape which includes surfaces which define a plurality of channels which extend rearwardly and are inclined, in plan, with respect to the central longitudinal vertical plane of the hull, the cross-sectional shape of each said channel being such that its said surface intercepts water when the hull is mobile and the water so intercepted moves firstly upwardly and rearwardly and then downwardly and rearwardly with respect to the hull thereby imparting kinetic energy to that water and transforming that kinetic energy into lift, sufficient length of said bottom having said channels that said lift occurs over a major portion of the length of the hull.

With this invention, there are three major advantages over prior art hulls. The channels deflect the flow of water over the hull bottom from the forefoot area, and this reduces the tendency to pound (hydraulically bottom). Secondly, the channels entrap air which cushions the pounding. Thirdly, it is but a simple matter to achieve a much more even distribution of lift at the centre and rear portions of the hull bottom than with a conventional hull, so that a hull which becomes airborne from riding a wave can descend to the water surface with much less pounding than a conventional hull.

BRIEF DESCRIPTION OF THE DRAWINGS

The invention is applicable to a wide range of shapes and proportions, and several embodiments are described hereunder in some detail with reference to and are illustrated in the accompanying drawings in which:

FIG. 1 is a side elevation of a hull which embodies the invention,

Figure 6:
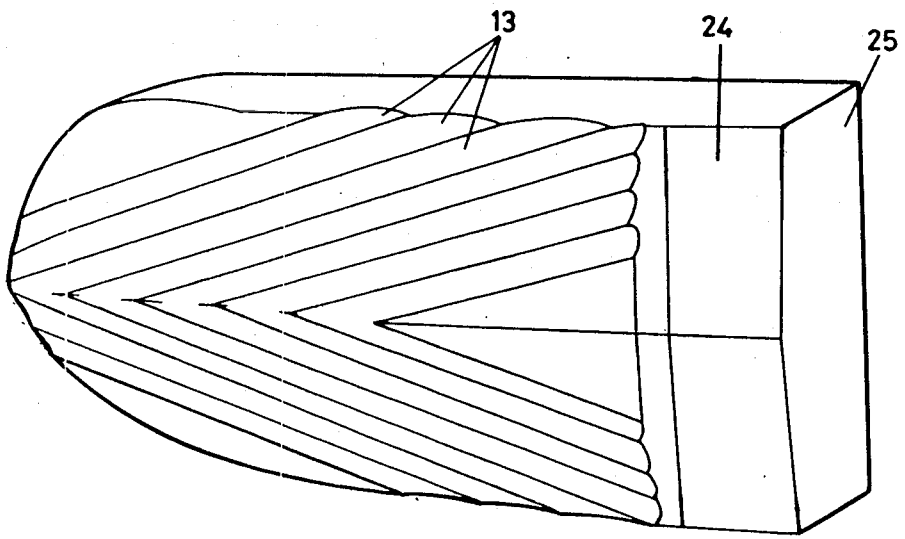
Figure 7:
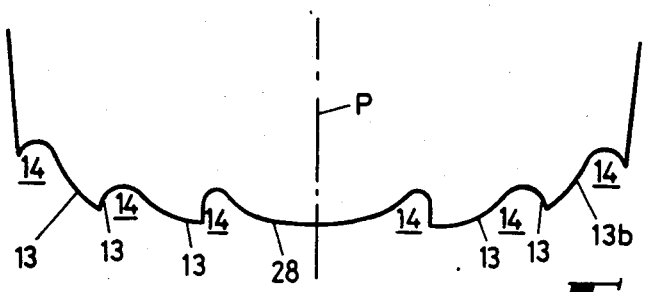
Figure 8:
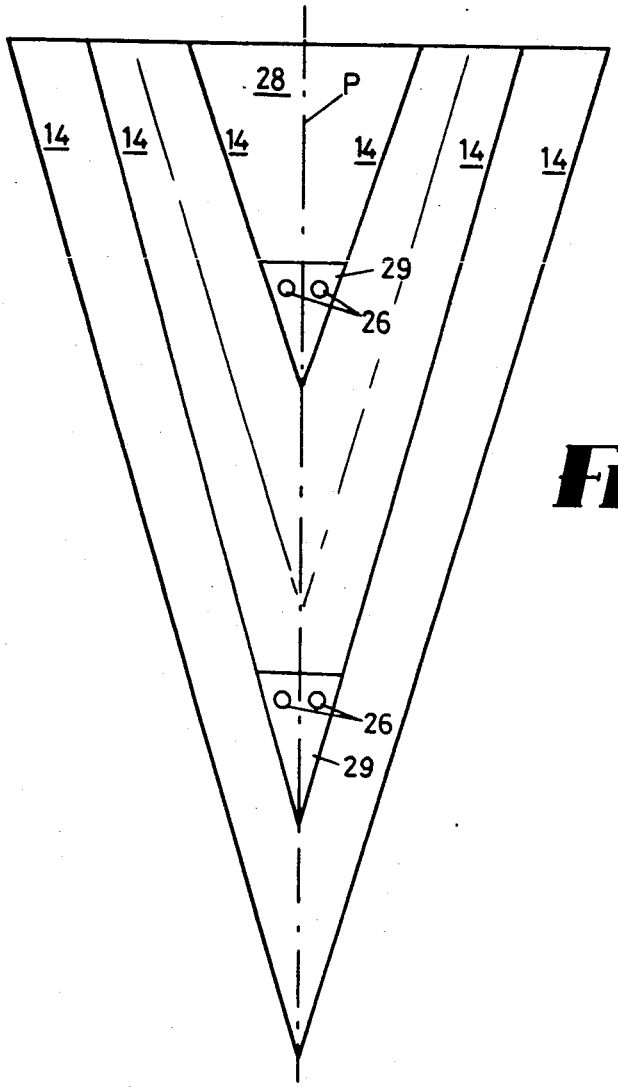
Figure 9:
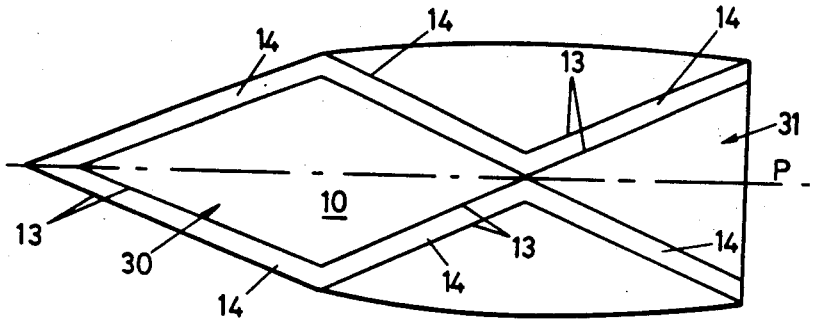
Figure 10:
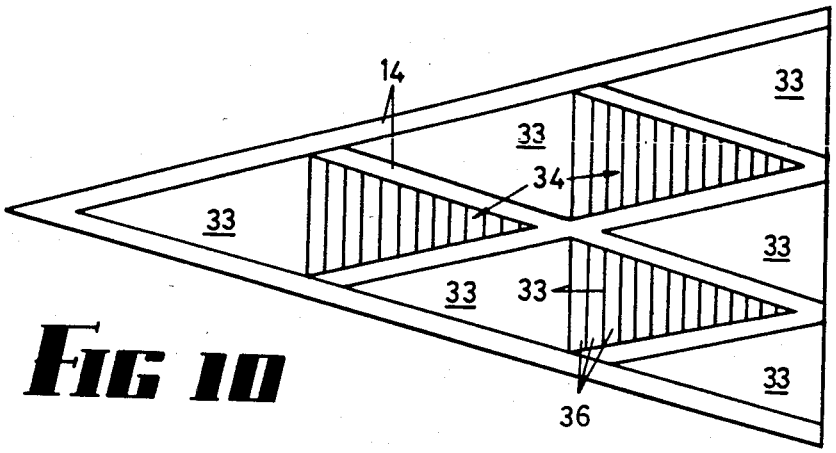
Figure 11:
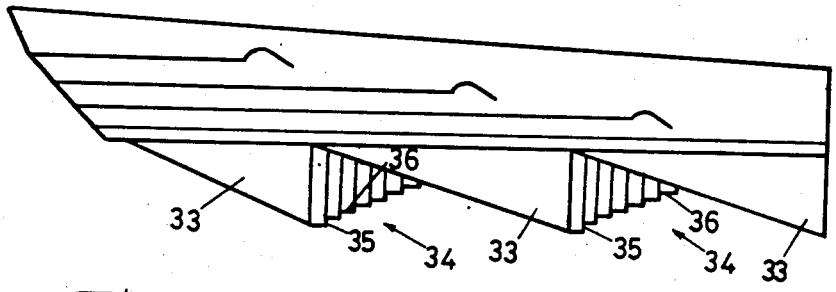

FIG. *2a* shows the cross-sectional shape of an inboard channel of FIG. 1,

FIG. *2b* shows the cross-sectional shape of an inboard channel of FIG. 1,

FIG. *2c* shows a cross-sectional shape similar to FIGS. *2a* and *2b*, but modified to have a step, FIG. 3 is a part section taken on line 3—3 of FIG. 1, FIG. 4 is a part section taken on line 4—4 of FIG. 1, FIG. 5 is a part section taken on line 5—5 of FIG. 1, FIG. 6 is an underside perspective view showing a hull according to a second embodiment, FIG. 7 is a rear end elevation of a hull according to a third embodiment, FIG. 8 is an underside view of FIG. 7, FIG. 9 is an underside view of a hull according to a fourth embodiment, FIG. 10 is an underside view of a hull according to a fifth embodiment, and FIG. 11 is a side elevation of a hull according to FIG. 10.

Referring first to the embodiments of FIGS. 1 through to 5 a marine planing hull 10 has a "trimaran" front 11, and a bottom 12 which comprises a plurality of channel surfaces 13, all of which extend laterally outwardly and rewardly from the central longitudinal plane 'P' and adjacent surfaces 13 between them defining channels 14 which at least partly guide the flow of water relative to the hull bottom when the hull is mobile through the water.

The channels 14 on one side of the central longitudinal vertical plane 'P' of the hull bottom define (in plan) an angle with corresponding channels on the other side thereof which is an acute angle at least in the forebody 15 but in this embodiment all the channels 14 on each side of the hull are parallel to each other but are inclined to plane 'P'(as they are also in FIG. 6). In this embodiment there is a "trimaran" or triple front 11 and the two outer hull portions define with the inner hull portion a pair of large channels 17. These are illustrated in detail in FIGS. *2a*, *2b*, 3 and 4. In all instances, the channel surfaces 13 of each channel 14 or 17 include side surfaces and an intermediate surface 18 which is downwardly concave. Further, the outboard side surfaces 19 are steeper than the inboard side surfaces 20 of each channel. The ribs 22 shown in FIGS. *2a* and *2b* are optional to the invention but are useful in further softening the ride, since they appear to separate some air from the water.

FIG. *2c* shows a minor variation of FIGS. *2a* and *2b*, wherein the step 23 assists in causing a reduction of the "wetted surface" of the bottom 12, without substantial loss of lift.

In the embodiment of FIG. 6, the channels 14 terminate in a shelf 24 which is forward of the transom 25, but in some other embodiments the channels extend through to the transom. Shelf 24 may be flat or of convex shape, or may be corrugated. It is in a horizontal plane and arranged so that most or all of its surface is just clear of the water when the hull is planing, and this reduces wetted surface area. Under displacement conditions, shelf 24 is beneath the surface of the water and provides some buoyancy. Shelf 24 does not necessarily extend right across the hull, but may be flanked by channels which extend to the stern.

FIGS. 7 and 8 illustrate a further embodiment wherein the underside view (FIG. 8) of the lower portion of the hull is generally triangular, the hull being provided with surfaces 13 which form channels 14 on each side which diverge from the channels 14 on the other side from the central longitudinal plane 'P', and between the surfaces 13, a central bottom portion 28 bridges the innermost channels and is downwardly convex. This is a relatively small portion which is triangular in plan as shown in FIG. 8. The central portion 28 can be so arranged that it is immersed at displacement speeds but clear of the water at planing speeds of the hull. Small downwardly convex triangular areas 29 at the junctions of channels 14 further reduce pounding (FIG. 8). The rear edges of these areas 29 are transverse, and there is a clean break-away of the water from these areas.

A model shape which has been produced and tested in a tank indicates that the flow of water encountering the strakes 13 is directed into channels 14 by its surfaces but the flow through the channels is not simple. The flow is complex and is different for different speeds.

At all angles of the channels 17 to the plane 'P' other than parallel, the lower outer edge of each surface 13 (FIG. *2b*) shields the internal volume beneath the concave surface 18 from direct contact with approaching waves. At the moment of contact with a wave, a layer of water is forced upward by the inboard surface 13, around the surface 18 in a clockwise direction until it emerges vertically downward having transformed its kinetic energy into vertical lift on the surface 18. Just before the wave rises above lower edge of 19, this high speed layer of downward moving water now meets the surface of the wave forcing entrained air below the wave surface. This mixture of turbulent water and air is then forced back against the surfaces 13 and 18 as the wave rises further and thus cushions the impact and spreads it over a greater time period and area of the hull, greatly reducing impact forces and making hydraulic bottoming or pounding impossible.

To allow the hull to start planing with less power a conduit or conduits 26 may connect to each channel such that air is allowed to be drawn into the channel 14 while in motion.

One of the causes of loss of direction which is frequently encountered is when waves strike a hull from a forward quarter and cause the hull to rotate about a vertical axis so as to change direction. This invention reduces the effect of such wave motions in that the surface water of the waves is distributed across the channels 14, and the channels function as shock absorbers because they are likely to include pockets of air.

Intercepting the upwardly directed bow wave by use of this invention increases the lift available to the hull and ensures spray from the boat is directed downwardly close to the hull so that it cannot be blown back inside the boat by wind.

By decreasing the cross-sectional area of each channel 14 in the vicinity of the bow, the bow shape is allowed to be sharp or fine at the forebody, and each channel above having increased length of curvature, the bow becomes rounded or full at deck level allowing superior performance with a following sea.

Water which freely enters the channel spaces and is accommodated thereby during the passage of the hull through the water has a large component of downward movement as it leaves the channels. Because the channels run at an angle to the central plane (FIG.8), and because maximum lift is when the water leaves the channels vertically downwardly, it is preferable to reduce the outward displacement and this can be achieved by angling surfaces 19 (FIG.2) inwardly and downwardly. However, near the rear ends of the channels, each surface 19 may be made to slope downwardly and outwardly to reduce generation of spray near the hull.

The cross-sectional area and shape of the channels need not be constant along their entire length. It has previously been mentioned the progressive reduction in area as the channels near the bow improve the shape of the bow. It is also generaly preferred to have the surfaces 13 of the channels 14 curved as shown in FIG. 7, but not necessarily of circular shape. Also if the channels are of increasing vertical angle (as are surfaces 13*b* in FIG. 7), the ride is softer but more propulsion power is required. Thus in the area near the stern, at the lowest part of the hull, the angles tend to be shallower, as are surfaces 13, and both at the bow and in the channels 14 higher on the side of the hull, the angle is more nearly vertical.

If the channels are inclined slightly upwardly when nearing the point of the bow, the bow tends to lift. If the forward end of the outer edge 13 (FIG. 2*b*) is inclined downwardly, the hull gives a "softer" ride, reducing pounding in an approaching sea.

In the interests of soft ride, the most favourable ratio of propulsion power to ride comfort is when the area and number of horizontally arranged channels is sufficient to just lift the hull at normal load and cruising speed, and the channels 14 are arranged similarly to FIG. 7. wherein the topmost curves of the channel surfaces 13 are all nearly at the same horizontal height as are their lower edges. Deepening of the central portion of the hull (eg. at 29 in FIG. 8 making the central curvature more convex downwardly) at the localities of the junctions of the channel pairs also reduces the pounding effect in that area. The effect of this modification to the front portion 29 (FIG. 8) has the effect of limiting "porpoising". Its rear surface can be made to slope upwardly and rearwardly with some advantage.

Succeeding channels above this level are arranged with greater variation of height and angled more vertically to reduce their lifting effect.

At the most rearward point of each channel 14 the shape of surface 13 is modified to prevent excess water which would not be caught by curve 18 from being forced upward. This can be done by changing the inboard rear portion of surface 13 to run parallel to the keel at its rear end, the surface generated by this change sloping upwardly and outwardly away from the keel. This is not illustrated.

Under certain conditions it is found that spray will rise vertically from the rear portions of the channels, eg in turns. To remedy this situation an inverted curved section runs from a relatively high point at the bow, rearward to the region where the curve of the bow finishes, and then drops more acutely following the points where each channel finishes forming a chine, to the stern of the hull. This chine redirects spray, improves the appearance of the hull, protects the edge of the strakes and allows a portion of the chine to facilitate loading on and off a trailer.

In respects other than those described above the principles set forth in the Lord textbook essentially apply. For example, in elongate hulls the channels can converge near their forward ends but constitute parallel running lines rearwardly of the central portion of the hull. It is profitable to provide a keel which connects the successive channel joining points.

Reference is now made to FIG. 9 which is an underside view wherein the channels 14 follow a zig-zag path, and in this embodiment the channels divide the bottom of the hull 10 into a forwardly located diamond-shape portion 30 and a rearward area portion 31 which may be flat but in this embodiment each of these portions constitutes conic surfaces or repeated arrangements of channels in zig-zag pattern shown in FIG. 9.

It will be seen that the channels are inclined in plan with respect to the longitudinal vertical plane 'P' of the hull, and thereby intercept the water so that, as in the other embodiments, it moves firstly upwardly and rearwardly and then downwardly and rear-wardly to impart kinetic energy to the water in the channels 14 and then transform that kinetic energy into lift, as the water is discharged both at the ends of the channels, and along the length of the channels.

The same effect is achieved also with the further embodiment illustrated in FIGS. 10 and 11. In this further embodiment (which is really an extension of FIG. 9) the envelope shape of each surface designated 33 is conic, and the rearwardly and upwardly sloping surfaces 34 comprise a series of transversely curved longitudinal portions arranged in step fashion, each step having a vertical transversely extending portion 35 and a horizontal transversely extending curved portion 36, and this stepped shape reduces the suction drag which might otherwise occur. When outboard motors are used, they are best carried on rearward extensions (not shown) behind the, or the respective, conic surfaces 33.

The invention reduces planing angle, reduces wetted surface, improves softness of ride, improves stability under rough water conditions, and reduces draft, when compared with V-bottom hulls having the same performance.

I claim:

1. A marine hull wherein the shape of the bottom includes surfaces which define a plurality of channels each of which extends both rearwardly and laterally outwardly, and is inclined, in plan, with respect to the central lognitudinal vertical plane of the hull, the cross-sectional shape of each said channel being defined by a surface which first interrupts and deflects the water into a downwardly concave channel portion which is itself of such shape that it further intercepts and deflects that water when the hull is mobile, and the water so intercepted and deflected moves firstly upwardly and rearwardly with respect to the hull thereby imparting a vertical component of kinetic energy to that water which then moves downwardly and rearwardly whereby change of direction transforms that kinetic energy into lift, sufficient length of said bottom having said channels extending across it that said lift occurs over a major portion of the length of the hull.

2. A marine hull according to claim 1 wherein the channels on one side of the longitudinal central plane define an angle with corresponding channels on the other side thereof, at said central longitudinal vertical plane of the hull.

3. A marine hull according to claim 1 wherein each said channel is defined by a pair of side suraces and an intermediate surface between those side surfaces, the outboard side surface being steeper than the inboard side surface.

4. A marine hull according to clailm 1 wherein some at least of said channels extend laterally outwardly and rearwardly of the locality of the forebody of the hull and open at their outer and rearward ends at chines of the hull.

5. A marine hull according to claim 1 wherein at least some of said channels open to the transom of the hull.

6. A marine hull according to claim 1 wherein said channels diverge and coverge rearwardly in a zig-zag pattern.

7. A marine hull according to claim 6 wherein said channels which diverge and converge rearwardly in a zig-zag pattern define a plurality of portions which have downwardly facing conic surfaces.

8. A marine hull according to claim 6 wherein some of said surfaces comprise a plurality of transversely extending steps to reduce drag.

9. A marine hull according to claim 1 further comprising air admission conduits opening into said channels near their foremost ends.

10. A marine hull according to claim 1 wherein the cross-section area and shape of each channel is not constant throughout its length.

11. A marine hull having a front portion and a water engaging surface which includes a plurality of channels formed within the contour of the hull, each of said channels extending both rearwardly and laterally outwardly with respect to the central longitudinal vertical plane of the hull, each of the channels having at least one sidwall that is inclined, with respect to said vertical plane, to a greater extend than the other sidewall, the cross sectional shape of each said channel being defined by a downwardly concave surface, said water engaging surface having said channels extending along a predetermined length.

12. A marine hull according to claim 11 wherein the outboard sidewall surfaces of said channels are steeper than the inboard sidewall surfaces such that the downwardly concave surface first interrupts and deflects the water into a downwardly concave path, and further intercepts and deflects that water when the hull is mobile, and the water so intercepted and deflected moves upwardly and rearwardly with respect to the hull thereby imparting a vertical component of kinetic energy to that water which then moves downwardly and rearwardly such that the change of direction of that water transforms that kinetic energy into lift, and wherein said predetermined length of said channels extends a major portion of the length of the hull, such that said lift occurs over a said major portion of said hull.

* * * * *